US008615817B2

(12) United States Patent
Phillips

(10) Patent No.: US 8,615,817 B2
(45) Date of Patent: Dec. 31, 2013

(54) PROTECTIVE HEADGEAR AND PROTECTIVE ARMOUR AND A METHOD OF MODIFYING PROTECTIVE HEADGEAR AND PROTECTIVE ARMOUR

(75) Inventor: Kenneth David Phillips, Middlesex (GB)

(73) Assignee: Phillips Helmets Limited, Middlesex (GB)

( * ) Notice: Subject to any disclaimer, the term of this patent is extended or adjusted under 35 U.S.C. 154(b) by 2417 days.

(21) Appl. No.: 10/483,281

(22) PCT Filed: Jul. 9, 2002

(86) PCT No.: PCT/GB02/03139

§ 371 (c)(1),
(2), (4) Date: Jan. 8, 2004

(87) PCT Pub. No.: WO03/005844

PCT Pub. Date: Jan. 23, 2003

(65) Prior Publication Data

US 2004/0168246 A1 Sep. 2, 2004

(30) Foreign Application Priority Data

Jul. 9, 2001 (GB) ..... 0116738.6

(51) Int. Cl.
*A63B 71/10* (2006.01)
*A42B 3/06* (2006.01)
*A42B 1/06* (2006.01)

(52) U.S. Cl.
USPC ..... 2/411; 2/2.5; 2/413; 2/410; 2/425

(58) Field of Classification Search
USPC ..... 2/411, 412, 413, 414, 425, 2.5
See application file for complete search history.

(56) References Cited

U.S. PATENT DOCUMENTS 2,197,174 A 4/1940 Crosby
2,971,195 A * 2/1961 Voss ..... 2/411

(Continued)

FOREIGN PATENT DOCUMENTS

DE 19961371 7/2001
GB 2213573 8/1989

(Continued)

OTHER PUBLICATIONS

Int'l Pre Exam Rep, Oct. 9, 2003.

(Continued)

*Primary Examiner* — Bobby Muromoto, Jr.
(74) *Attorney, Agent, or Firm* — Gable & Gotwals

(57) ABSTRACT

The present invention provides protective headgear comprising a shell (26) having an inwardly facing surface which in use faces the head (10) of a user of the headgear and an outwardly facing surface which in use faces away from the head (10) of a user. An outer layer (28) overlies at least a portion of the outwardly facing surface of the shell (26) and rupturing means (30) is provided for fixedly attaching the outer layer (28) to the remainder of the headgear at one or more locations. The rupturing means (30) is configured so as to fail when a force greater than a selected threshold is received on an outer surface (28) of the headgear which acts in an at least part tangential direction to rotate the headgear and the head (10) of the user. Upon failure of the rupturing means (30) at the one or more locations, the received force causes at least part of the outer layer (28) receiving the force to move relative to the shell (26) in a manner which is similar to the protective movement of the human scalp (18) relative to the skull (16). The present invention also relates to protective armor (100) and to a method of modifying protective headgear and protective armor.

59 Claims, 9 Drawing Sheets

(56) References Cited

U.S. PATENT DOCUMENTS

| | | | | | |
|---|---|---|---|---|---|
| 3,413,656 | A | | 12/1968 | Vogliano et al. | |
| 3,787,893 | A | * | 1/1974 | Larcher | 2/413 |
| 3,946,441 | A | * | 3/1976 | Johnson | 2/412 |
| 3,999,220 | A | * | 12/1976 | Keltner | 2/413 |
| 4,012,794 | A | * | 3/1977 | Nomiyama | 2/411 |
| 4,307,471 | A | | 12/1981 | Lovell | |
| 4,937,888 | A | | 7/1990 | Straus | |
| 4,987,609 | A | * | 1/1991 | Zahn | 2/6.8 |
| 5,059,467 | A | * | 10/1991 | Berkovitz | 428/137 |
| 5,259,071 | A | * | 11/1993 | Scott et al. | 2/413 |
| 5,687,426 | A | * | 11/1997 | Sperber | 2/411 |
| 5,697,098 | A | * | 12/1997 | Miguel-Bettencourt et al. | 2/2.5 |
| 5,794,271 | A | * | 8/1998 | Hastings | 2/412 |
| 5,890,232 | A | * | 4/1999 | Park | 2/413 |
| 5,956,777 | A | * | 9/1999 | Popovich | 2/424 |
| 6,751,808 | B2 | * | 6/2004 | Puchalski | 2/411 |
| 6,766,537 | B1 | * | 7/2004 | Maki et al. | 2/171.3 |
| 2001/0032351 | A1 | * | 10/2001 | Nakayama et al. | 2/412 |
| 2004/0117896 | A1 | * | 6/2004 | Madey et al. | 2/411 |
| 2004/0168246 | A1 | * | 9/2004 | Phillips | 2/411 |

FOREIGN PATENT DOCUMENTS

| | | |
|---|---|---|
| GB | 2365750 | 2/2002 |
| RU | 2112411 | 6/1998 |
| SU | 856430 | 8/1981 |
| SU | 1391584 | 4/1988 |
| WO | WO 96/14768 | 5/1996 |
| WO | WO 01/45526 | 6/2001 |

OTHER PUBLICATIONS

Int'l Search Report, Nov. 7, 2002.

Written Opinion, May 24, 2003.

* cited by examiner

PROTECTIVE HEADGEAR AND PROTECTIVE ARMOUR AND A METHOD OF MODIFYING PROTECTIVE HEADGEAR AND PROTECTIVE ARMOUR

The present invention relates to protective headgear such as safety helmets for use when motorcycling or pedal cycling, or when taking part in hazardous sporting activities such as climbing, horse riding or white water rafting. The present invention is also relevant in an industrial context for safety helmets used on construction sites, in factories and in military applications. Indeed, the present invention may be employed in any environment where a form of protective headgear is desired which is lightweight and unencumbering for the user whilst being effective in preventing or minimising the effects of an impact to the head. A particular feature of the present invention is its ability to mimic characteristics of the human head in order to provide protection against injury.

The present invention also relates to protective armour such as body armour used by riot police and the armed forces.

Various forms of head protection are known in the art which have sought to diffuse and spread the impact of falls or blows by constructing protective helmets of hard materials. It is usual to provide a polystyrene or similar foam liner or webbing support inside such helmets both for energy absorption and for comfort. However, many such "hard hats" have limited capacity for energy absorption and simply transmit the forces of an impact to the head of a user, albeit over a wider area. Worse still, certain helmets have allowed the source of an impact to come into direct contact with the head of a user once the hard material has been sacrificed or breached, particularly in cases of severe impact. For example, in U.S. Pat. No. 3,946,441 there is disclosed a safety helmet which comprises a primary shell having tough impact resisting properties and a second outer shell formed from a brittle material which is designed to fracture even upon minor impacts.

Protective armour is also known in the art and in the past one particular use of such armour has been to protect the body when playing hazardous or contact sports. In U.S. Pat. No. 3,500,472 there is disclosed a protective garment having cushioning means which are inserted into pockets on the protective garment and inflated. In use, the garment is designed to restrict any relative movement between the cushioning means and the pocket means when the garment is subjected to impacts.

The present invention takes note of and incorporates certain protective features of the human head, which in itself is capable of absorbing and dissipating considerable amounts of energy, thereby protecting against impacts. Protective headgear and protective armour incorporating such features is disclosed by the applicant in EP 0790787. The present invention is concerned with improvements in the apparatus and methods disclosed in EP 0790787.

The present invention provides, in a first aspect, protective headgear comprising:

a shell having an inwardly facing surface which in use faces the head of a user of the headgear and an outwardly facing surface which in use faces away from the head of a user;

an outer layer which overlies at least a portion of the outwardly facing surface of the shell; and rupturing means for fixedly attaching the outer layer to the remainder of the headgear at one or more locations, wherein:

the rupturing means is configured so as to fail when a force greater than a selected threshold is received on an outer surface of the headgear which acts in an at least part tangential direction to rotate the headgear and the head of the user, and upon failure of the rupturing means at the one or more locations, the received force causes at least part of the outer layer receiving the force to move relative to the shell in a manner which is similar to the protective movement of the human scalp relative to the skull.

In a second aspect, the present invention provides protective headgear comprising:

a shell having an inwardly facing surface which in use faces the head of a user of the headgear and an outwardly facing surface which in use faces away from the head of a user;

an outer layer which overlies at least a portion of the outwardly facing surface of the shell; and means for fixedly attaching the outer layer to the remainder of the headgear at one or more locations, wherein the outer layer is configured so as to yield when a force greater than a selected threshold is received on an outer surface of the headgear which acts in an at least part tangential direction to the outer surface of the headgear to rotate the headgear and the head of the user, and upon yielding of the outer layer, the received force causes at least part of the outer layer receiving the force to move relative to the shell in a manner which is similar to the protective movement of the human scalp relative to the skull.

In a third aspect, the present invention provides protective armour comprising:

a base layer having an inwardly facing surface which in use faces the body of a user of the armour and an outwardly facing surface which in use faces away from the body of a user;

an outer layer which overlies at least a portion of the outwardly facing surface of the base layer; and rupturing means for fixedly attaching the outer layer to the remainder of the armour at one or more locations, wherein:

the rupturing means is configured so as to fail when a force greater than a selected threshold is received on an outer surface of the armour which acts in an at least part tangential direction to rotate the armour and the body of the user, and upon failure of the rupturing means at the one or more locations, the received force causes at least part of the outer layer receiving the force to move relative to the base layer in a manner which is similar to the protective movement of the human scalp relative to the skull.

In a fourth aspect, the present invention provides protective armour comprising:

a base layer having an inwardly facing surface which in use faces the body of a user of the armour and an outwardly facing surface which in use faces away from the body of a user;

an outer layer which overlies at least a portion of the outwardly facing surface of the base layer; and means for fixedly attaching the outer layer to the remainder of the armour at one or more locations, wherein:

the outer layer is configured so as to fail when a force greater than a selected threshold is received on an outer surface of the armour which acts in an at least part tangential direction to the outer surface of the armour to rotate the armour and the body of the user, and upon failure of the outer layer, the received force causes at least part of the outer layer receiving the force to move relative to the base layer in a manner which is similar to the protective movement of the human scalp relative to the skull.

In a fifth aspect, the present invention provides a method of modifying existing protective headgear wherein:

an outer layer is provided to overlie at least a portion of an outwardly facing surface of the existing protective headgear; and rupturing means are provided for fixedly attaching the outer layer to the remainder of the existing protective headgear at one or more locations, the rupturing means being configured so as to fail when a force greater than a selected threshold is received on an outer surface of the modified headgear which acts in an at least part tangential direction to rotate the modified headgear and the head of the user, and upon failure of the rupturing means at the one or more locations, the received force causes at least part of the outer layer receiving the force to move relative to the outwardly facing surface of the existing protective headgear in a manner which is similar to the protective movement of the human scalp relative to the skull.

In a sixth aspect, the present invention provides a method of modifying existing protective headgear wherein:

an outer layer is provided to overlie at least a portion of an outwardly facing surface of the existing protective headgear; and means is provided for fixedly attaching the outer layer to the remainder of the existing protective headgear at one or more locations, the outer layer being configured so as to fail when a force greater than a selected threshold is received on an outer surface of the modified headgear which acts in an at least part tangential direction to the outer surface of the modified headgear to rotate the modified headgear and the head of the user, and upon failure of the outer layer, the received force causes at least part of the outer layer receiving the force to move relative to the outwardly facing surface of the existing protective headgear in a manner which is similar to the protective movement of the human scalp relative to the skull.

In a seventh aspect, the present invention provides a method of modifying existing protective armour wherein:

an outer layer is provided to overlie at least a portion of an outwardly facing surface of the existing protective armour; and rupturing means are provided for fixedly attaching the outer layer to the remainder of the existing protective armour at one or more locations, the rupturing means being configured so as to fail when a force greater than a selected threshold is received on an outer surface of the modified armour which acts in an at least part tangential direction to rotate the modified armour and the body of the user, and upon failure of the rupturing means at the one or more locations, the received force causes at least part of the outer layer receiving the force to move relative to the outwardly facing surface of the existing protective armour in a manner which is similar to the protective movement of the human scalp relative to the skull.

In an eigth aspect, the present invention provides a method of modifying existing protective armour wherein:

an outer layer is provided to overlie at least a portion of an outwardly facing surface of the existing protective armour; and means is provided for fixedly attaching the outer layer to the remainder of the existing protective armour at one or more locations, the outer layer being configured so as to fail when a force greater than a selected threshold is received on an outer surface of the modified armour which acts in an at least part tangential direction to the outer surface of the modified armour to rotate the modified armour and the body of the user, and upon failure of the outer layer, the received force causes at least part of the outer layer receiving the force to move relative to the outwardly facing surface of the existing protective armour in a manner which is similar to the protective movement of the human scalp relative to the skull.

Preferred embodiments of the present invention will now be described by way of example only with reference to the accompanying drawings, in which.

Figure 4:
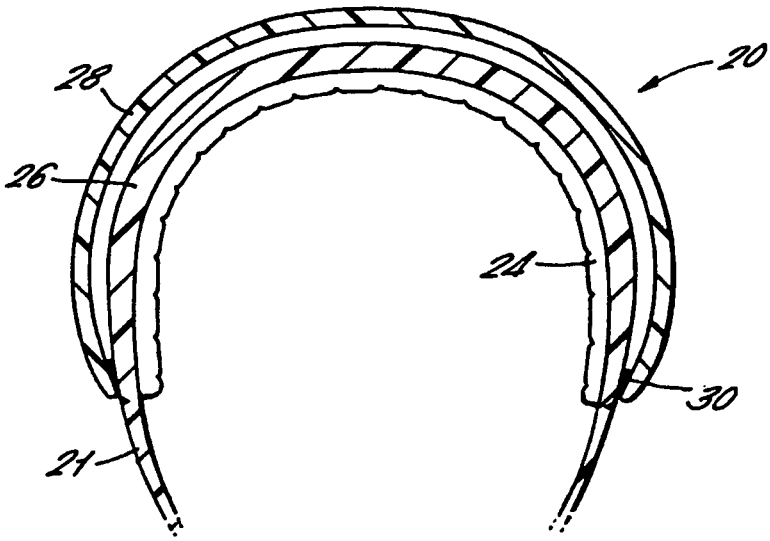
FIG. 4 is a cross section of a first embodiment of protective headgear according to the present invention.
Figure 5:
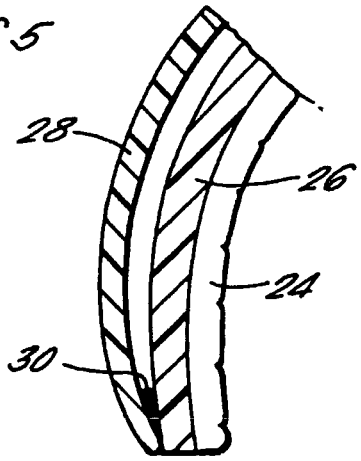
FIG. 5 is an enlarged detail view illustrating a method of attachment of an outer layer to a lower peripheral edge of the protective headgear of FIG. 4.
Figure 8A:
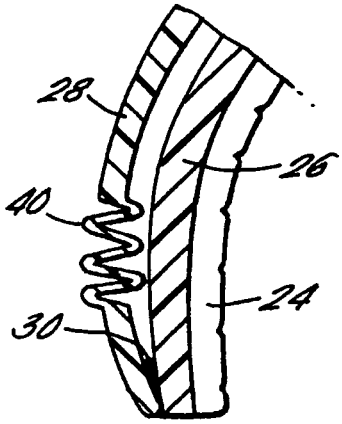
Figure 8B:
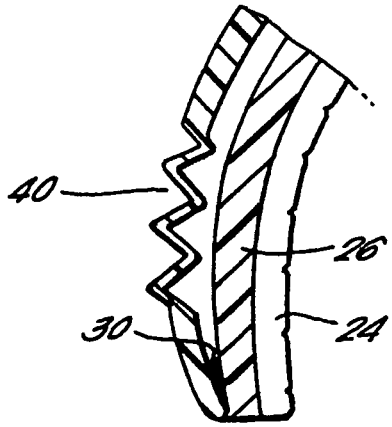
Figure 6A:
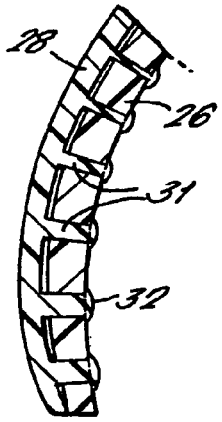
Figure 6B:
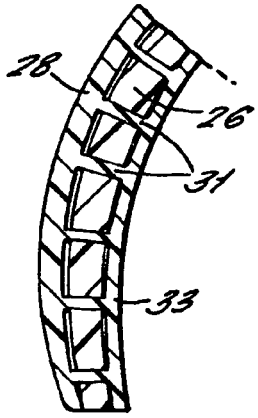
Figure 6C:
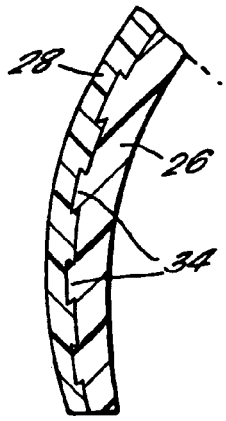
Figure 7A:
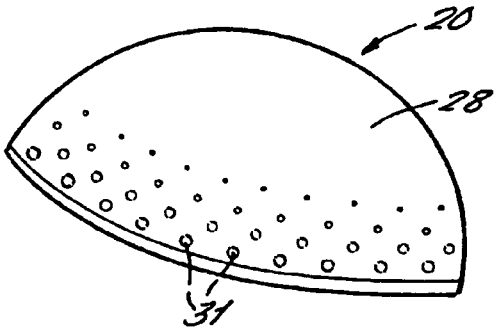
Figure 7B:
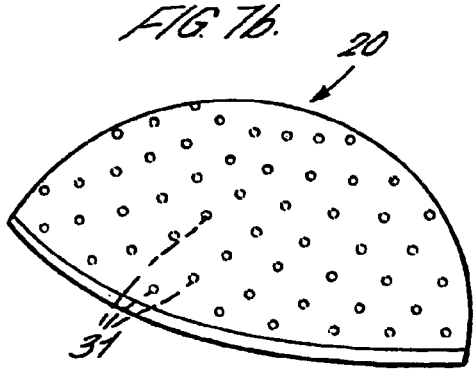
Figure 7C:
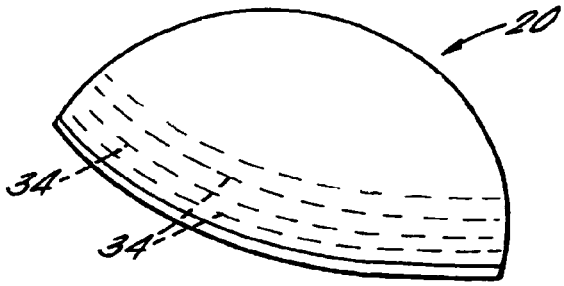
Figure 9A:
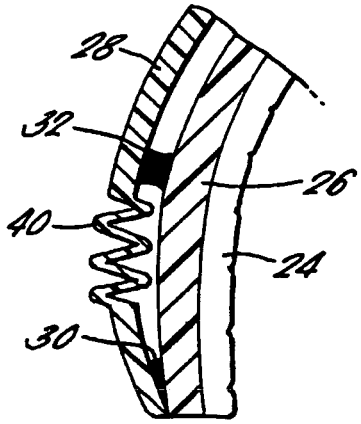
Figure 9B:
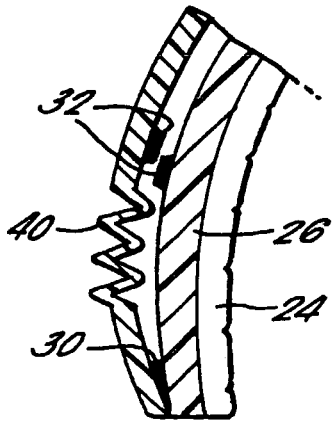
Figure 9C:
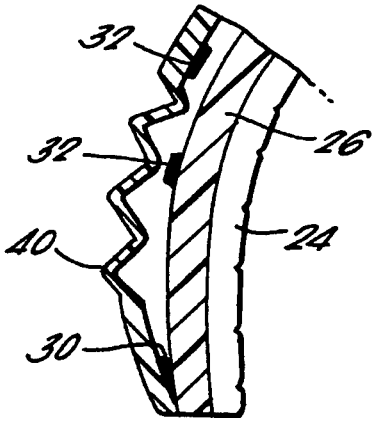
Figure 10A:
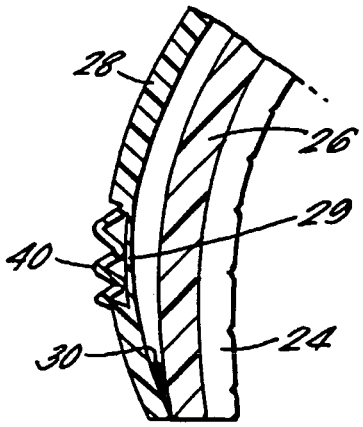
Figure 10B:
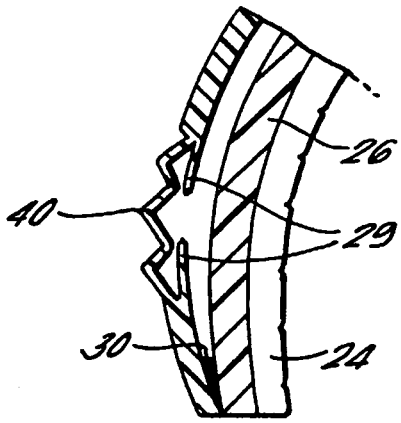
Figure 11:
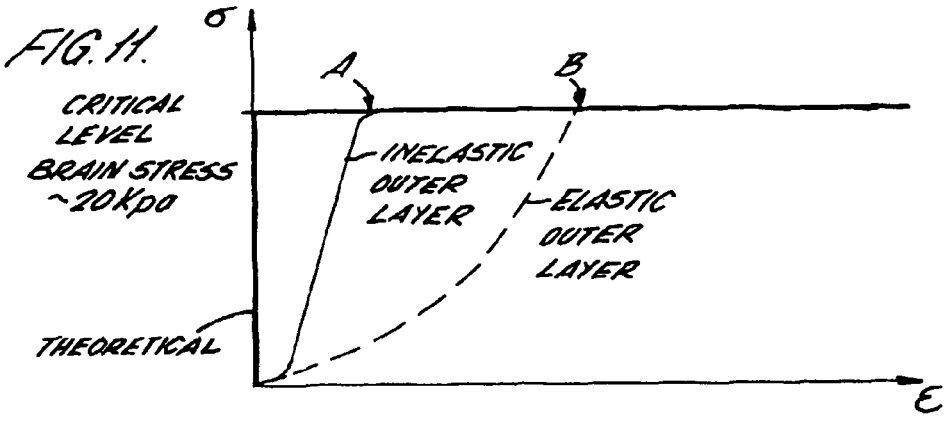
Figure 12:
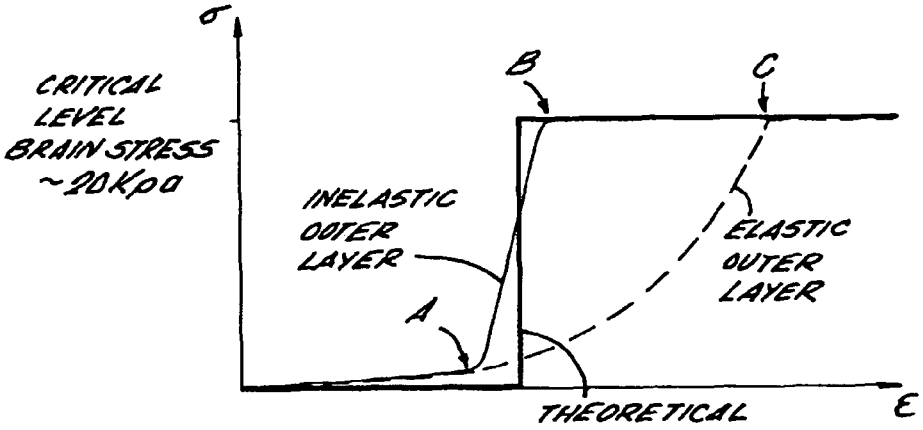

FIGS. 6*a*, 6*b* and 6*c* are detail cross section views illustrating alternative methods of attachment of an outer layer to a lower peripheral edge of the protective headgear according to the present invention;

FIGS. 7*a*, 7*b* and 7*c* are perspective views (from above) illustrating typical distributed attachment locations of an outer layer to the protective headgear of FIGS. 6*a*, 6*b* and 6*c* respectively;

FIGS. 8*a* and 8*b* are detail views of a lower peripheral edge of an alternative embodiment of protective headgear according to the present invention, illustrating an outer layer in first and second positions (before and during/after impact);

FIGS. 9*a*, 9*b* and 9*c* are detail views of a lower peripheral edge of a further embodiment of protective headgear according to the present invention, illustrating successive positions of an outer layer (before, during and after impact);

FIGS. 10*a* and 10*b* are detail views of a lower peripheral edge of a yet further embodiment of protective headgear according to the present invention, illustrating first and second positions of an outer layer (before and during/after impact);

FIG. 11 is a schematic representation illustrating preferred stress/strain characteristics of an outer layer of the protective headgear of FIGS. 4 and 5;

FIG. 12 is a schematic representation illustrating preferred stress/strain characteristics of an outer layer of the protective headgear of FIGS. 8*a* and 8*b;*

Figure 13:
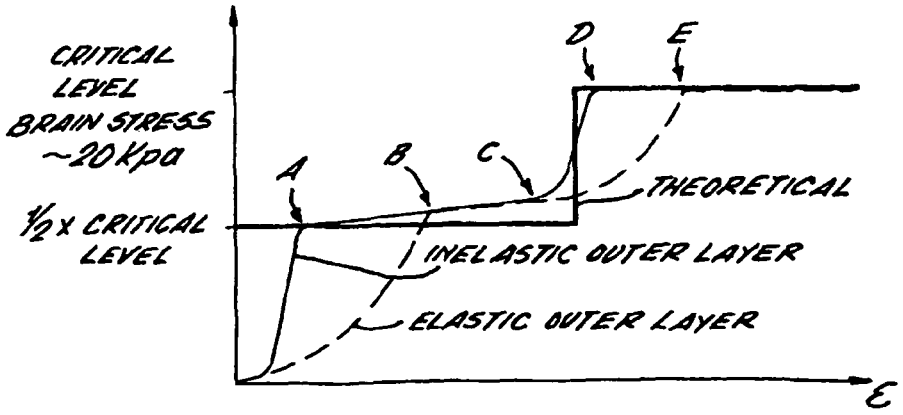

FIG. 13 is a schematic representation illustrating preferred stress/strain characteristics of an outer layer of the protective headgear of FIGS. 9*a*, 9*b* and 9*c*, and of FIGS. 10*a* and 10*b;*

Figure 14:
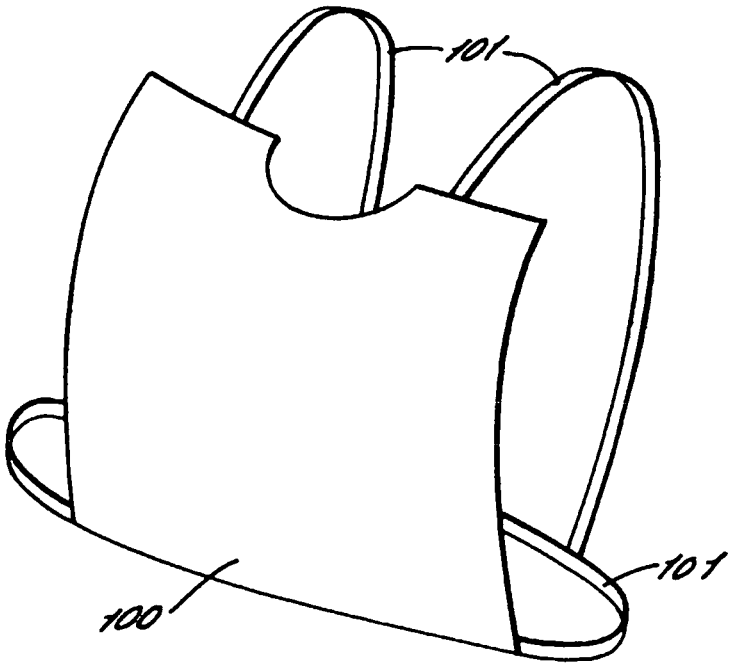
Figure 15:
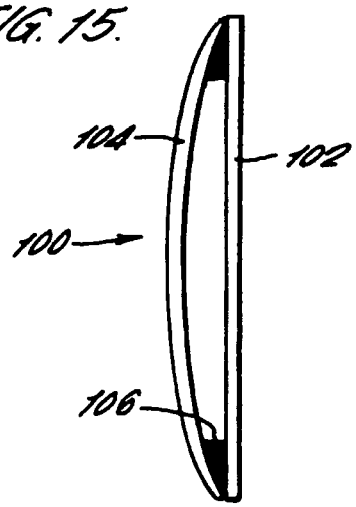
Figure 16A:
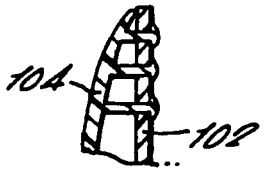
Figure 16B:
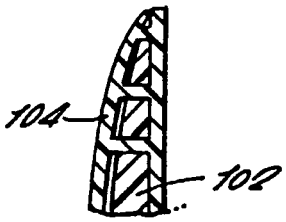
Figure 16C:
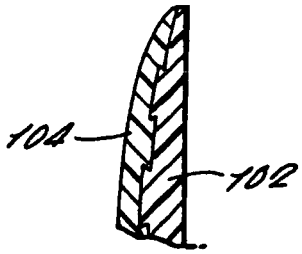
Figure 16D:
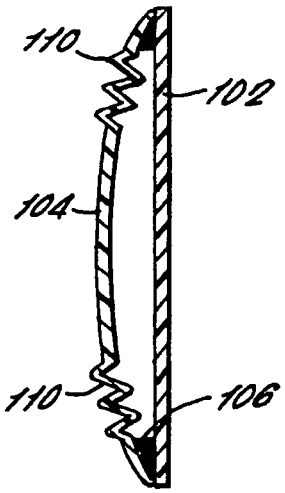
Figure 16E:
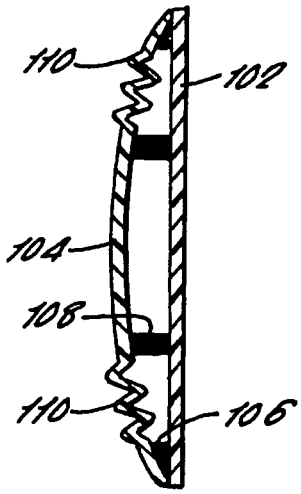

FIG. 14 is a schematic illustration of body armour according to the present invention;

FIG. 15 is a cross section through the body armour of FIG. 14; and

FIGS. 16*a*, 16*b*, 16*c*, 16*d* and 16*e* are detail cross section views illustrating alternative methods of attachment of an outer layer to a base layer of the protective armour according to the present invention.

Figure 1:
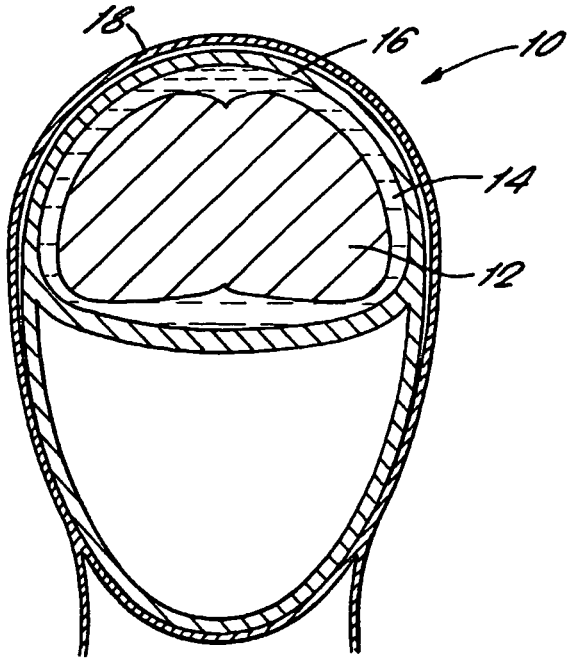
FIG. 1 is a schematic representation of a human head in coronal cross section.
Figure 2:
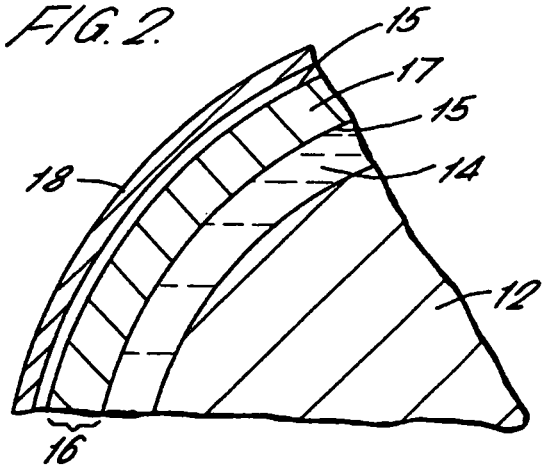
FIG. 2 is an enlarged detail view of the coronal cross section of FIG. 1.

Referring first to FIG. 1, there can be seen a schematic representation of the human head 10 in coronal cross section. The brain 12 is surrounded by cerebro-spinal fluid 14 and both are contained within the skull 16. On the outside of the skull 16 is the scalp 18. An enlarged detail view of the coronal cross section of FIG. 1 is illustrated in FIG. 2.

The protective features of the human head 10 are as follows:

The Scalp

The scalp 18 is a firm fibrous layer which is substantially inelastic in shear but elastic when subjected to loading in the normal direction. Of particular importance is the fact that the scalp 18 is not attached firmly to the skull 16 but is instead free to move relative to the skull 16 by limited distances before it begins to tear. The ability of the scalp 18 to move relative to the skull 16 is important because it is this mechanism which helps counter the effects of tangential components of force in an impact, the brain 12 being particularly susceptible to damage from sudden rotational motion relative to the skull 16. The elasticity of the scalp 18 in the normal direction allows for compression which serves to absorb energy from impacts having a normal component of force.

The Skull

The skull 16 is composed of two layers of dense, compact bone 15 "sandwiching" a layer of spongy cancellous bone 17. This structure provides a hard surface 15 for energy dissipation, allowing a degree of compression or crushing of the cancellous bone 17 for energy absorption and also spreading the area over which an impact acts. The cancellous bone 17 may also allow a degree of distortion of the skull 16 before any fracture occurs.

The Cerebro-Spinal Fluid

The cerebro-spinal fluid 14 surrounding the brain 12 acts as a further energy absorbing element, cushioning the brain 12 from movements within the cranium. Blows or impacts to the head 10 project the brain 12 towards the cranium, and the resultant displacement of incompressible cerebro-spinal fluid 14 acts as a decelerating medium, absorbing energy.

By mimicking certain of the above protective features of the human head 10, the protective headgear and protective armour of the present invention can be effective in attenuating, and in certain cases neutralising, both normal and tangential components of force sustained during an impact.

Figure 3:
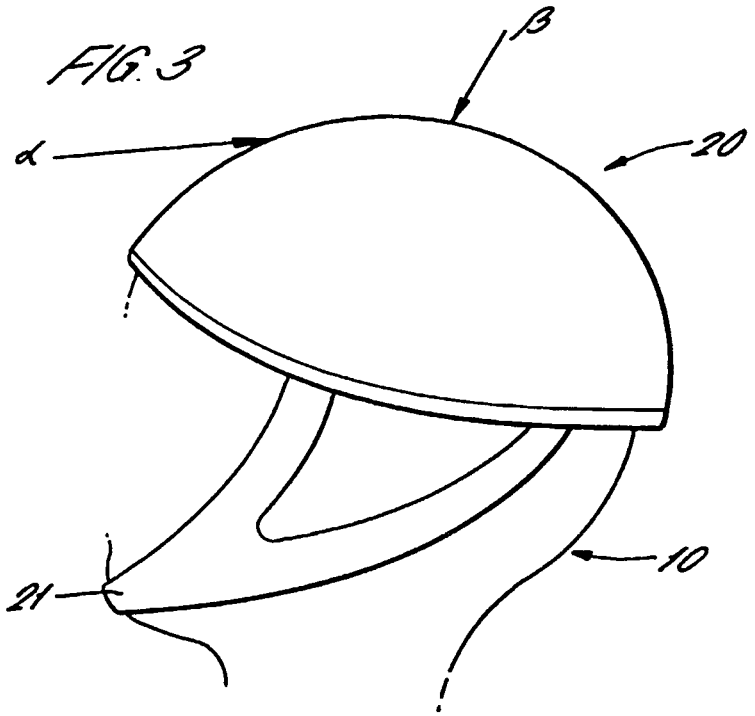
FIG. 3 illustrates a typical form of protective headgear according to the present invention in use.

FIG. 3 illustrates a first embodiment of protective headgear according to the present invention in the form of a cycle helmet 20 secured to the head 10 of a user via a chin strap 21. It will be appreciated that the protective headgear of the present invention may take the form of other embodiments such as a traditional "hard hat" or motorcycle helmet, the latter more fully enclosing the head 10 of the user. Other known means for securing protective headgear to the head of a user may be utilised in the present invention. Impacts received on the outer surface of the helmet 20 will have tangential $\alpha$ and normal $\beta$ force components.

FIGS. 4 and 5 illustrate in cross section the helmet 20 of FIG. 3 which can be seen to comprise an outer layer 28, a shell 26, and an inner liner 24.

Whilst not essential, inner liner 24 may be provided inside of the shell 26 to interface with a user's head 10. The liner 24 can serve to mimic the fluid suspension provided by the cerebro-spinal fluid 14 and/or ensure a more comfortable and safer fit of the helmet 20 upon the head 10 of the user. Preferably, inner liner 24 comprises a flexible sac filled with an appropriately viscous liquid (not shown) which will be affixed to the inner surface of the shell 26 using any conventional fixing means (e.g. by bonding with an adhesive or by mechanical fasteners). Since fluid in a unicellular sac would gravitate to the lower peripheral edge of the helmet 20, compartmentalisation may be necessary to allow a suitable mode of displacement of fluid under impact. Flow control mechanisms between compartments can be included to control flow between the compartments. The flow control mechanisms prevent flow of fluid between compartments in normal use but allow flow of fluid between compartments when the helmet 20 is subject to an impact. The interconnection of compartments will help development of a uniform pressure in all of the compartments, thereby spreading the effect of an impact over a large area. The fluid in the inner liner 24 may be a viscous or aqueous fluid and acts to damp motion of the head 10 of a user relative to the helmet 20 when the helmet 20 is subject to an impact. The flow control means could comprise lines of weakness in walls dividing the compartments, the walls remaining intact to seal off the compartments in normal use but the lines of weakness breaking to form apertures in the walls (and thus allow flow of fluid) in impact conditions. In an alternative embodiment, a "bubble pack" type inner liner 24 can be provided either with a liquid filling, a liquid and gas combination, or solely a gas filling.

In addition, a thin polystyrene or similar liner (not shown) bonded or otherwise affixed on the inside face of the flexible sac inner liner 24 could be used to maintain the shape of and thus the fluid distribution within the sac in which case compartmentalisation of the sac will not necessarily be used. The thin polystyrene or similar liner could be designed to fully enclose the flexible sac.

Also, an additional layer or layers (not shown) may be interposed between the shell 26 and the flexible sac inner liner 24. Indeed, an additional layer or layers may also or alternatively be provided on the inside face of the flexible sac inner liner 24. The additional layer or layers may take the form of any conventional lining material used in protective headgear known in the art, such as low density foam or combinations of low and higher density foams.

Alternatively, the inner liner 24 may instead take the form of any conventional energy absorbing lining material used in protective headgear known in the art and omit the flexible sac altogether. This inner liner 24 may be a foamed material having inherent compliance or alternatively a webbing material commonly used in hard hats for the construction industry. Indeed, the inner liner 24 may comprise a number of discrete layers or be formed as a laminate material. For example, one such modification involves providing two layers of plastic foam, in combination with a polystyrene liner, either both outside the polystyrene liner, or one outside and the other inside the polystyrene liner. These foam layers can be either low density or combinations of low and higher density foams. It will be appreciated from the above that many different alternatives and combinations of inner liner 24 are envisaged for the present invention.

The shell 26 mimics the skull 16 and thus provides a hard surface for energy dissipation (similar to the compact dense bone 15 of the skull 16) whilst allowing a degree of compression or crushing to facilitate increased energy absorption (similar to the cancellous bone 17 of the skull 16). Using conventional manufacturing techniques, such properties can be achieved either in a single material or in a composite or laminate structure. In testing, suitable materials for the shell 26 have been found to include polypropylene, polycarbonate, ABS, polycarbonate/ABS blend, high density polyethylene (HDPE), carbon fibre composites, glass reinforced plastics, Zytel (a nylon manufactured by DuPont), Celstran (a long strand glass, carbon or aramid fibre material in a modulus carrier such as polypropylene, polyethylene, polycarbonate, ABS, TPU or nylon), Twintex (glass fibre reinforced polypropylene manufactured by Vetrotex), Curv PP (a polypropylene fibre reinforced material manufactured by BP), and Kevlar composites (aramid fibres in a resin carrier).

Outer layer 28 is designed to mimic the scalp 18. Accordingly, in a first embodiment, there is provided an outer layer 28 which is substantially inelastic in shear but elastically compressible when subjected to forces in the normal direction (similar to the scalp 18). However, it has been found in testing that a second embodiment comprising an outer layer 28 which is substantially elastic both in shear and when subjected to forces in the normal direction can also be effective. Accordingly, when selecting suitable material(s) for the outer layer 28, consideration is given both to the desired mechanical properties of the material(s) in question and to the desired mode of operation of the protective headgear. In testing, suitable materials for the outer layer 28 have been found to include thermoplastic elastomers such as Santoprene (manufactured by Advanced Elastomer Systems in a range of grades), Hytrel in a solid or foamed form, thermoset elastomers such as polyurethane elastomers (typically in the hardness range 50 shore A to 70 shore D), High Q (a rubber manufactured by Astron), sorbothane, natural or synthetic rubbers or plasticised foams, low or high density polyethylene (LDPE or HDPE) as well as conventional thermoplastic and thermosetting plastics well known in the art. The outer layer 28 may be optionally reinforced with high stiffness, low elongation fibres such as glass, carbon or aramid (Kevlar) fibres in order to reduce the overall elasticity of this outer layer. Such fibre reinforcement may take the form of random or unidirectional fibres, woven or knitted fabrics or scrims which are then moulded into the outer layer.

It is envisaged that bespoke composite or laminate structures may be beneficially employed in order to obtain optimum mechanical properties and performance characteristics of the protective headgear. For example, in achieving an inelastic outer layer 28 which is compressible in the normal direction, a substantially inelastic layer (both in shear and in the normal direction) may be combined with an elastic layer such that the resulting structure is substantially inelastic in shear but is capable of elastic compression in the normal direction. Suitable composite or laminate structures may be manufactured using standard methods well known in the art including, for example, in-mould, co-moulding (or bi-moulding), glass scrim and co-extrusion techniques.

Since the outer layer 28 could be a porous material, waterproofing may be desirable to prevent water being absorbed and detrimentally affecting the desired mechanical properties of the helmet 20. This could be achieved using conventional waterproofing techniques such as spray on compositions, or by the superimposition (not shown) of a thin but durable layer which is impervious to water, or by both methods. Additionally, where it is desirable to reduce the coefficient of friction of the outer layer 28, the waterproofing treatment selected could serve this purpose also. Alternatively, where waterproofing is not required or desired, only a low coefficient of friction material or layer may be superimposed on the outer layer 28.

In order to reproduce the beneficial protective features of the human head 10, attachment of the outer layer 28 to the hard shell 26 is critical. Several modes of attachment of outer layer 28 to the hard shell 26 are envisaged and will now be described in turn.

In the embodiment illustrated in FIGS. 4 and 5, outer layer 28 is simply bonded to the lower peripheral edge of shell 26 with a band of adhesive 30. Suitable adhesives include, for example, 3M double sided VHB tape, 3M adhesive type 1099, Loctite cyanoacrylate and epoxy resin. Alternatively, conventional mechanical fixing means could be employed. Outer layer 28 is otherwise unattached and thus free to move relative to the shell 26 so as to mimic the protective movement of the scalp 18. A lubricant such as an oil or grease (with or without additives such as molybdenum disulphide) or other low friction element such as a layer of PTFE may be applied to either one or both facing surfaces or interposed (not shown) between outer layer 28 and the shell 26 so as to reduce friction and aid relative 20 movement therebetween.

Upon impact, force components β normal to the helmet 20 cause elastic compression of the outer layer 28 in a normal direction, thus absorbing and dissipating energy. Tangential force components α induce shear forces in the outer layer 28.

With an outer layer 28 which is substantially inelastic in shear, provided the magnitude of shear 30 force does not exceed the shear strength of the adhesive 30 or that which causes the material of outer layer 28 to yield and/or tear, these shear forces are transmitted directly via the adhesive bond 30 to the hard shell 26. However, if the magnitude of an impact 35 is such that the shear stress induced in the outer layer 28 exceeds the shear strength of the adhesive band 30 or the yield and/or tear strength of the material of outer layer 28, then failure of the hand 30 or yielding or tearing of the outer layer 28 (or possibly all three) will occur. In this situation, outer layer 28 is free to move relative to the hard shell 26 and provides a low friction surface between the source of the impact and the hard shell 26 which permits relative movement therebetween. This so-called "failure" mode is deliberate and is effective in countering the tangential force component α, limiting or preventing the resultant rotational forces from being imparted to the rest of the safety helmet 20 attached to a user's head 10. This is important in reducing or eliminating the transmission of rotational forces via the helmet 20 to the brain 12.

Alternatively, with an outer layer 28 which is substantially elastic in shear, provided the magnitude of shear force does not exceed the shear strength of the adhesive 30 or that which causes the material of outer layer 28 to yield or tear, these shear forces are transmitted via the adhesive bond 30 to the shell 26, but typically to a lesser degree than the actual forces received. The level of transmission of the shear forces from the outer layer 28 to the shell 26 varies in dependence upon the energy dissipated in the elastic stretching and relaxing of the outer layer 28. If the outer layer 28 is stretched on impact (e.g. with a road surface) but relaxes when the helmet 20 is no longer in contact with the source of the impact or another body, there will be no reactionary force other than within the outer layer 28 and thus little or no recoil of the helmet 20, and energy dissipation will occur. This is because outer layer 28 is free to move relative to the shell 28 and provides a low friction surface between the source of the impact and the hard shell 26 which permits relative movement therebetween. However, if the magnitude of an impact is such that the shear stress induced in the outer layer 28 exceeds the shear strength of the adhesive band 30 or the yield and/or tear strength of the material of outer layer 28, then failure of the band 30 or yielding and/or tearing of the outer layer 28 (or possibly all three) will occur. In this situation, outer layer 28 is free to move relative to the hard shell 28 and provides a low friction surface between the source of the impact and the shell 26 which permits relative movement therebetween.

These "failure" (operating) modes are effective in countering the tangential force component α, limiting or preventing the resultant rotational forces from being imparted to the rest of the safety helmet 20 attached to a user's head 10. This is important in reducing or eliminating the transmission of rotational forces via the helmet 20 to the brain 12. Studies have indicated that rotational forces which result in a level of brain stress in excess of 20 Kpa can cause damage to the human brain. Thus, for the purposes of the present invention, the 20 Kpa brain stress figure represents a critical threshold. Accordingly, the shear strength of the adhesive band 30 and/or the material chosen for outer layer 28 will be selected deliberately with this in mind (i.e. to fail below the critical threshold causing brain stresses of 20 Kpa) since this is clearly a very important factor in preventing brain damage from occurring in an impact.

FIG. 11 is a schematic representation illustrating preferred stress/strain characteristics of the failure modes described above. Referring first to the embodiment having an inelastic outer layer 28, the stress (y-axis) can be seen to increase with a marginal increase in strain (x-axis) until a point A which represents failure of the adhesive band 30 or yielding and/or tearing of the outer layer 28. Beyond this point, the "extension" component of strain tends to infinity. Secondly, referring to the embodiment having an elastic outer layer 28, the stress can be seen to increase with increasing strain until a point B which represents failure of the adhesive band 30 or yielding and/or tearing of the outer layer 28. Beyond this point, the "extension" component of strain tends to infinity.

It must be stressed that the schematic of FIG. 11 (and indeed of FIGS. 12 and 13 referred to below) is a schematic for illustrative purposes only. It does not reflect exact performance characteristics which will of course vary in dependence on the particular combination of materials selected for the helmet 20.

Alternative methods of attaching outer layer 28 to the hard shell 26 are illustrated in FIGS. 6*a*, 6*b* and 6*c* where, for the sake of simplicity and clarity, inner liner 24 within the shell 26 is not shown. Referring first to FIG. 6*a*, the outer layer 28 can be seen to comprise protrusions 31 terminating in flanged heads 32 which pass through mating apertures provided in the shell 26. The flanged heads 32 lie adjacent to the inner surface of shell 26, retaining the outer layer 28 in position. The flanged heads 32 together with protrusions 31 maintain the outer layer 28 in position until failure occurs at a designated shear strength, e.g. of a level giving rise to brain stresses of 20 Kpa or less. This arrangement obviates the need for an adhesive (although in certain circumstances an adhesive may of course be used in conjunction with such a joint).

A similar arrangement is illustrated in FIG. 6*b*. However, in place of the flanged heads 32, an entire inner layer 33 is provided so as to retain outer layer 28 in position over the hard shell 26. The protrusions 31 and inner layer 33 are designed such that failure of the protrusions 31 occurs at a designated shear strength, e.g. of a level giving rise to brain stresses of 20 Kpa or less. Again, this arrangement can forgo the need for an adhesive. Furthermore, the presence of an entire inner layer 33 may be beneficially employed as an inner liner 24, thus eliminating the need for a separate additional inner liner.

A yet further arrangement is illustrated in FIG. 6*c*. In this arrangement, the shell 26 is formed with dovetail tenons 34 which are designed to interface with mating dovetail tenons formed in outer layer 28. Failure of these interfaces is designed to occur at a designated shear strength, e.g. of a level giving rise to brain stresses of 20 Kpa or less. Once again, this arrangement may obviate the need for an adhesive.

In each of the arrangements illustrated in FIGS. 6*a*, 6*b* and 6*c*, outer layer 28 is preferably formed directly on the shell 26 using, for example, in-mould, co-mould or two-shot manufacturing methods. These conventional methods, well known in the art, ensure exacting tolerances are met reliably and consistently so as to ensure the desired failure modes (e.g. as described above). The attachment of outer layer 28 to the shell 26 in each case may occur solely at the lower peripheral edge of the shell 26, as illustrated in FIGS. 7*a* and 7*b* or in regions all over the surface of the shell 26, as illustrated in FIG. 7*c*. The arrangement illustrated in FIG. 7*c* effectively "spot welds" the outer layer 28 to the shell 26. Such an arrangement can of course be achieved in the FIG. 4 embodiment described above by using adhesive at each desired attachment location.

Whilst a threshold brain stress level of 20 Kpa is the critical figure above which brain damage has been found to occur, it may of course be desirable (indeed preferable) to design to a much lesser figure at which the particular failure mode occurs (e.g. of a level giving rise to brain stresses of, say, 5, 10, or 15 Kpa). Furthermore, it may be preferable in certain applications to provide a method of attachment which fails progressively at levels equivalent to brain stress levels of, for example, 5, 10, 15 and 20 Kpa, either in a direction from the vertex of the helmet 20 towards the lower peripheral edge of the helmet 20, or otherwise. Such an arrangement is illustrated in FIG. 7*a*, where smaller diameter apertures in the hard shell 26 house correspondingly sized diameter of protrusions 31 of outer layer 28. These aperture/protrusion combinations increase in diameter towards the lower peripheral edge of the helmet 20 to achieve the desired mode of incremental failure in an impact.

FIGS. 8*a* and 8*b* are detail views illustrating an alternative embodiment of outer layer 28 which is employed to obtain a particular characteristic of relative motion between it and the shell 26 before failure, as will now be described with reference to FIG. 12.

Outer layer 28 is attached to the shell 26 around the lower peripheral edge thereof in a similar fashion to that described above and illustrated in FIGS. 4 and 5, i.e. by bonding with an adhesive band 30 (although the other methods of mechanical attachment described above are equally applicable). However, outer layer 28 is additionally provided with an intermediary band 40 of concertina form. The intermediary band 40 may be formed as integral part of outer layer 28 or as a separate part attachable thereto. The intermediary band 40 configured so as to be proximal to the lower peripheral edge of helmet 20. In the case of a substantially inelastic outer layer 28, the intermediary band 40 retains the outer layer 28 taught over the shell 26 as illustrated in FIG. 8*a*. Upon impact, intermediary band 40 undergoes plastic deformation and expands as illustrated in FIG. 8*b*, permitting relative movement of outer layer 28 with respect to hard shell 26 before ultimate failure occurs in the usual way described above (once the intermediate band 40 has reached its full extension). In the case of a substantially elastic outer layer 28, the intermediary band 40 is naturally biased so as to retain the outer layer 28 taught over the shell 26 as illustrated in FIG. 8*a*. Upon impact, intermediary band 40 undergoes elastic deformation and expands as illustrated in FIG. 8*b*, permitting relative movement of outer layer 28 with respect to shell 26 before ultimate failure occurs in the usual way describe above (once the intermediate band 40 has reached its full extension).

These failure modes are illustrated in FIG. 12, a schematic representation illustrating preferred stress/strain characteristics. Referring first to the embodiment having an inelastic outer layer 28, the strain (x-axis) can be seen to increase with a marginal increase in stress (y-axis) until the intermediary band 40 reaches full extension at point A. After this point, the stress can be seen to increase with marginal increases in strain until a point B which represents failure of the adhesive band 30 or yielding and/or tearing of the outer layer 28. Beyond this point, the "extension" component of strain tends to infinity. Secondly, referring to the embodiment having an elastic outer layer 28, the stress can be seen to increase with increasing strain until a point C which represents failure of the adhesive band 30 or yielding and/or tearing of the outer layer 28. Beyond this point, the "extension" component of strain tends to infinity.

The intermediary band 40 may consist of the same material as outer layer 28 or may be formed of a material having greater or lesser compliance than the outer layer 28. The outer layer 28 is attached to the shell 26 only via the intermediary band 40 and thus the remainder of the outer layer 28 is free to move relative to the underlying shell 26. The intermediary band 40 need not be of concertina form but may instead take any form which provides a specified region for plastic or elastic deformation of outer layer 28 on impact.

A layer of lubricant gel or other friction reducing material may be provided between the outer layer 28 and the shell 26 and this facilitates relative movement between the outer layer 28 and the shell 26. Suitable lubricants and friction reducing materials include (but are not limited to) silicone, Kluber paint on PTFE, molybdenum grease and Kluber food grade grease.

A further embodiment of helmet 20 is illustrated in FIG. 9*a*, 9*b* and 9*c*. In this embodiment the outer layer 28 is also provided with an intermediary band 40 attached to the shell 26 in a similar fashion to that described above and illustrated in FIGS. 8*a* and 8*b*. However, an additional peripheral band of adhesive 32 or other means of fixing is provided in a generally proximal location, but more distal than the intermediary band 40, as is best illustrated in FIG. 9*a*. The outer layer 28 is attached to the shell 26 only via the adhesive bands 30, 32 and thus outer layer 28 is otherwise free to move relative to the shell 26. Preferably, however, the additional adhesive band 32 is designed to have a lower shear strength equivalent to brain stress levels of, say, 10 Kpa. Thus, under the action of an impact to the helmet 20 which generates brain stress levels of up to 10 Kpa, the mode of operation of outer layer 28 is similar to that for the embodiments illustrated in FIGS. 4 and 5. However, should the shear stress level attained in the outer layer 28 exceed a level equivalent a brain stress level of 10 kpa, the adhesive band 32 will shear, resulting in a subsequent mode of operation of outer layer 28 similar to that for the FIG. 8*a* and 8*b* embodiments illustrated and described above. Again, the relative movement may be assisted by the interposition of a low friction surface (e.g. PTFE) or other lubricating layer between the outer layer 28 and the shell 26.

These failure modes are illustrated in FIG. 13, a schematic representation illustrating preferred stress/strain characteristics. Referring first to the embodiment having an inelastic outer layer 28, the stress (y-axis) can be seen to increase with a marginal increase in strain (x-axis) until a point A which represents failure of the adhesive band 32, following which the strain can be seen to increase with a marginal increase in stress until the intermediary band 40 reaches full extension at point C. After this point, the stress can be seen to increase with a marginal increase in strain until a point D which represents failure of the adhesive band 30 or yielding and/or tearing of the outer layer 28. Beyond this point, the "extension" component of strain tends to infinity. Secondly, referring to the embodiment having an elastic outer layer 28, the stress can be seen to increase with increasing strain until a point B which represents failure of the adhesive band 32, following which the strain can be seen to increase with increasing stress until the intermediary band 40 reaches full extension at point C. After this point, the stress can be seen to increase with increasing strain until a point which represents failure of the adhesive band 30 or yielding and/or tearing of the outer layer 28. Beyond this point, the "extension" component of strain tends to infinity.

A further embodiment of helmet 20 is illustrated in FIGS. 10*a* and 10*b*. In this embodiment the outer layer 28 is provided with an intermediary band 40 and attached to the shell 26 in a similar fashion to that described above and illustrated in FIGS. 8*a* and 8*b*. However, instead of providing an additional band of adhesive 32 as illustrated in FIGS. 9*a*, 9*b* and 9*c*, a shearable band 29 is provided in parallel with the intermediate band 40. This shearable band 29, like the adhesive band 32, is designed to have a shear strength equivalent to brain stress levels of, say 10 Kpa. Thus, under the action of an impact to the helmet 20 which generates brain stress levels of up to 10 Kpa, the mode of operation of outer layer 28 is similar to that for the embodiment illustrated in FIGS. 4 and 5. However, should the shear stress level attained in the outer layer 28 reach or exceed a level equivalent to brain stress levels of 10 kpa, the shearable band 29 will shear, resulting in a mode of operation of the outer layer 28 similar to that for the FIG. 8*a* and 8*b* embodiment illustrated and described above.

These failure modes are also depicted by FIG. 13. Referring first to the embodiment having an inelastic outer layer 28, the stress (y-axis) can be seen to increase with a marginal increase in strain (x-axis) until a point A which represents failure of the shearable band 29, following which the strain can be seen to increase with a marginal increase in stress until the intermediary band 40 reaches full extension at point C. After this point, the stress can be seen to increase with a marginal increase in strain until a point D which represents failure of the adhesive band 30 or yielding and/or tearing of the outer layer 28. Beyond this point, the "extension" component of strain tends to infinity. Secondly, referring to the embodiment having an elastic outer layer 28, the stress can be seen to increase with increasing strain until a point B which represents failure of the shearable band 29, following which the strain can be seen to increase with increasing stress until the intermediary band 40 reaches full extension at point C. After this point, the stress can be seen to increase with increasing strain until a point which represents failure of the adhesive band 30 or yielding and/or tearing of the outer layer 28. Beyond this point, the "extension" component of strain tends to infinity.

It should be noted that the materials listed above as being suitable for outer layer 28 and the shell 26 are exemplary and not limiting, since the important criteria in each case is the particular arrangement of materials and the interaction of each's mechanical properties in arriving at a helmet 20 which mimics the protective features of the human head 10. It will be appreciated that ongoing work in the field of materials science will yield new materials or new combinations of existing materials (not to mention manufacturing techniques) which are equally appropriate for use in the present invention.

In all of the above embodiments, the inwardly facing surface of outer layer 28 and the outwardly facing surface of shell 26 may incorporate a lubricant or friction reducing material to dispense with the need for an intermediary layer such as a lubricant gel or friction reducing layer.

Substantial testing has been carried out on embodiments of helmet according to the invention, and very significant reductions were achieved in the maximum tangential force transmitted by the safety helmet 20 to the head 10 of a user. Also, a moderate decrease in the maximum linear acceleration forces was achieved.

The combination of materials for the headgear will be chosen bearing in mind that the sound insulation qualities of the combination may represent a hazard in motorcycle or pedal cycle applications. It is always possible to provide perforations in the ear area of the protective headgear.

In military/aeronautical applications additional material or earcups would provide noise protection and additional protection against lateral blows which tend to cause fractures of the base of the skull. Also visual protection and enhancement devices could be incorporated in the helmet and also respiratory devices such as gas masks and air purifiers.

Since the heat insulation qualities of the described helmets could be high if certain material combinations are chosen, provision must be made for ventilation in appropriate weather conditions. Inlet and outlet ports will be provided with variable control of the air inlet and consideration will given to the provision of ventilation ports on the vertex in applications where there is no generated air flow.

In many accidents, particularly in industrial mishaps involving a fall, the helmet is flung off. The retention system is, therefore, a critical element of head protection. On each side of the helmet 20 there is preferably a two point attachment, one in front and the other behind the central transverse vertical plane. Typically, there is provided either a double strap 21 joined to form a chin strap or cup, or a single strap from each point of attachment, the anterior strap providing a chin restraint and the posterior strap an occipital restraint. The retention system will inevitably depend on the shape of the helmet and its particular application.

A further aspect of the present invention is the conversion of existing "hard hats" to hats with "soft" outer skins according to the invention, preferably with the provision of effective retention systems. Soft covers and new retention systems designed for attachment to existing headgear are included in the scope of the invention. Furthermore, it is envisaged that interchangeable or replaceable outer layers may be produced for use with the various embodiments of the present invention. Essentially, the outer layers will be produced in various colours and graphic designs, rather like replacement covers for mobile telephones. It is not recommended that these outer layers be used to replace "damaged" outer layers since the structural integrity of remainder of the helmet 20 may have been compromised, even if such damage is not readily visible to the eye.

Whilst above the present invention is described with reference to its use for protective headgear, the invention can also be applied to protective armour, such as body armour. The same principle of using an overlying outer layer can be used, as can the methods of attachment to a base plate of the armour, and the various "failure" modes described above.

Referring to FIG. 14, there is illustrated protective armour in the form of a breast plate 100 which can be worn in front of a user and secured by straps 101. FIG. 15 illustrates a cross section through the protective armour of FIG. 14, the breast plate 100 comprising a base layer 102 which has a first surface which in use is presented to receive impact blows. The armour also comprises an outer layer 104 which overlies the first surface of the base layer 102. Outer layer 104 is designed to resemble the scalp 18. Accordingly, in a first embodiment, there is provided an outer layer 104 which is substantially inelastic in shear but elastically compressible when subjected to forces in the normal direction (similar to the scalp 18). However, it has been found in testing that a second embodiment comprising an outer layer 104 which is substantially elastic both in shear and when subjected to forces in the normal direction can also be effective. The base layer 102 mimics the skull 16 and thus provides a hard surface for energy dissipation whilst allowing a degree of compression or crushing to facilitate increased energy absorption. Suitable materials for the outer layer 104 and base layer 102 include those listed and described above for the protective headgear.

The outer layer 104 may be attached to the base layer 102 in a similar fashion to, and using any of the mechanisms described above for the protective headgear. These embodiments are illustrated in FIGS. 16*a*, 16*b*, 16*c*, 16*d* and 16*e*.

An intermediary layer of lubricant gel may beneficially be included between the outer layer 104 and the base layer 102 and facilitates relative motion between them. This layer is not essential and could be replaced by a solid layer of a material of a low coefficient of friction (e.g. a layer of PTFE). Alternatively a lubricant could be incorporated into the inner surface of one or other or both of the outer layer 104 and base layer 102.

The protective armour is constructed in such a way that when the components of force of an impact are received by the outwardly facing surface of the outer layer 104, the mode of dissipating and absorbing the energy is identical to that for the protective headgear described above.

The present invention also provides a method of modifying protective armour comprising providing a "soft" outer layer to cover an existing base plate.

The invention claimed is:

1. Protective headgear comprising:

a shell having an inwardly facing surface which in use faces the head of a user of the headgear and an outwardly facing surface which in use faces away from the head of a user;

an outer layer which overlies at least a portion of the outwardly facing surface of the shell; and rupturing means for fixedly attaching the outer layer to a remainder of the headgear at one or more locations, wherein:

the rupturing means is configured so as to fail when a force greater than a selected threshold is received on an outer surface of the headgear which acts in an at least part tangential direction to rotate the headgear and the head of the user, and upon failure of the rupturing means at the one or more locations, the received force causes at least part of the outer layer receiving the force to move relative to the shell in a manner which is similar to the protective movement of the human scalp relative to the skull.

2. Protective headgear as claimed in claim 1 wherein the rupturing means is a discreet item interposed between the shell and the outer layer.

3. Protective headgear as claimed in claim 1 wherein the rupturing means is an integral part of the outer layer.

4. Protective headgear as claimed in claim 1 wherein the rupturing means is an integral part of the shell.

5. Protective headgear as claimed in claim 1 wherein the rupturing means comprises an adhesive.

6. Protective headgear as claimed in claim 5 wherein the adhesive comprises any one or combination of double sided tape, adhesive type 1099, cyanoacrylate or epoxy resin.

7. Protective headgear as claimed in claim 1 wherein the rupturing means comprises mechanical fastening means.

8. Protective headgear as claimed in claim 1 wherein the rupturing means is graduated so as to fail incrementally, with partial failure of the rupturing means occurring at a force less than the selected threshold and partial failure continuing with increasing force until total failure of the rupturing means occurs at the selected threshold.

9. Protective headgear as claimed in claim 8 wherein graduation of the rupturing means is achieved by varying the strength or interface characteristics of the rupturing means at one or more attachment locations.

10. Protective headgear as claimed in claim 1 wherein the outer layer is substantially inelastic in shear.

11. Protective headgear as claimed in claim 10 wherein the outer layer undergoes plastic deformation prior to failure of the rupturing means when a force less than the selected threshold is received on the outer surface of the headgear.

12. Protective headgear as claimed in claim 11 wherein the outer layer is provided with regions for localised plastic deformation on receiving a force which is less than the force required to cause the rupturing means to fail.

13. Protective headgear as claimed in claim 12 further comprising additional rupturing means which is configured to fail at a selected threshold lower than that selected for the rupturing means.

14. Protective headgear as claimed in claim 13 wherein the additional rupturing means prevents plastic deformation of the outer layer until the additional rupturing means fails.

15. Protective headgear as claimed in claim 1 wherein the outer layer is substantially elastic in shear.

16. Protective headgear as claimed in claim 15 wherein the outer layer undergoes elastic deformation prior to failure of the rupturing means when a force less than the selected threshold is received on the outer surface of the headgear, the outer layer receiving the force less than the selected threshold moving relative to the shell in a manner which is similar to the protective movement of the human scalp relative to the skull.

17. Protective headgear as claimed in claim 16 wherein the outer layer is provided with regions for localised elastic deformation which deform elastically at a force less than that required to cause elastic deformation of other regions of the outer layer, the force received being one which is less than the force required to cause the rupturing means to fail.

18. Protective headgear as claimed in claim 17 further comprising additional rupturing means which is configured to fail at a selected threshold lower than that selected for the rupturing means.

19. Protective headgear as claimed in claim 18 wherein the additional rupturing means prevents elastic deformation of the outer layer in the regions for localised elastic deformation until the additional rupturing means fails.

20. Protective headgear as claimed in claim 13 wherein the additional rupturing means comprises an adhesive.

21. Protective headgear as claimed in claim 13 wherein the additional rupturing means comprises a shearable band.

22. Protective headgear as claimed in claim 1 wherein the shell comprises a composite material.

23. Protective headgear as claimed in claim 1 wherein the shell comprises a laminate structure.

24. Protective headgear as claimed in claim 1 wherein the shell comprises any one or more of polypropylene, polycarbonate, ABS, polycarbonate/ABS blend, high density polyethylene, carbon fibre composites, glass reinforced plastics, nylon, glass fibre reinforced polypropylene, or aramid fibres in a resin carrier.

25. Protective headgear as claimed in claim 1 wherein the outer layer comprises a composite material.

26. Protective headgear as claimed in claim 1 wherein the outer layer is a laminate structure.

27. Protective headgear as claimed in claim 1 wherein the outer layer comprises any one or more thermoplastic elastomers.

28. Protective headgear as claimed in claim 1 wherein the outer layer is reinforced with high stiffness, low elongation fibres so as to reduce the overall elasticity of the outer layer.

29. Protective headgear as claimed in claim 1 further comprising a layer of low density foam located between the shell and the head of a user.

30. Protective headgear as claimed in claim 1 further comprising a layer of incompressible fluid located between the shell and the head of a user and encapsulated in a flexible sac.

31. Protective headgear as claimed in claim 30 wherein the incompressible fluid is a fluid which resists flow between compartments in order to damp motion of the shell.

32. Protective headgear comprising:

a shell having an inwardly facing surface which in use faces the head of a user of the headgear and an outwardly facing surface which in use faces away from the head of a user;

an outer layer which overlies at least a portion of the outwardly facing surface of the shell; and means for fixedly attaching the outer layer to a remainder of the headgear at one or more locations, wherein the outer layer is configured so as to fail when a force greater than a selected threshold is received on an outer surface of the headgear which acts in an at least part tangential direction to the outer surface of the headgear to rotate the headgear and the head of the user, and upon failure of the outer layer, the received force causes at least part of the outer layer receiving the force to move relative to the shell in a manner which is similar to the protective movement of the human scalp relative to the skull.

33. Protective headgear as claimed in claim 32 wherein the means for fixedly attaching the outer layer to a remainder of the headgear at one or more locations comprises an adhesive.

34. Protective headgear as claimed in claim 33 wherein the adhesive comprises any one or combination of double sided tape, adhesive type 1099, cyanoacrylate or epoxy resin.

35. Protective headgear as claimed in claim 32 wherein the means for fixedly attaching the outer layer to the headgear at one or more locations comprises mechanical fastening means.

36. Protective headgear as claimed in claim 32 wherein the outer layer is substantially inelastic in shear.

37. Protective headgear as claimed in claim 36 wherein the outer layer undergoes plastic deformation prior to failure of the means for fixedly attaching the outer layer to a remainder of the headgear at one or more locations.

38. Protective headgear as claimed in claim 36 wherein the outer layer is provided with regions for localised plastic deformation on receiving a force which is less than the force required to cause the means for fixedly attaching the outer layer to a remainder of the headgear at one or more locations to fail.

39. Protective headgear as claimed in claim 32 wherein the outer layer is substantially elastic in shear.

40. Protective headgear us claimed in claim 39 wherein the outer layer undergoes elastic deformation prior to failure of the means for fixedly attaching the outer layer to a remainder of the headgear at one or more locations when a force less than the selected threshold is received on the outer surface of the headgear, the outer layer moving relative to the shell in a manner which is similar to the protective movement of the human scalp relative to the skull.

41. Protective headgear as claimed in claim 39 wherein the outer layer is provided with regions for localised elastic deformation which deform elastically at a force less than that required to cause elastic deformation of other regions of the outer layer, the force received being one which is less than the force required to cause failure of the means for fixedly attaching the outer layer to the headgear at one or more locations.

42. Protective headgear as claimed in claim 32 wherein the shell comprises a composite material.

43. Protective headgear as claimed in claim 32 wherein the shell comprises a laminate structure.

44. Protective headgear as claimed in claim 32 wherein the shell comprises any one or more of polypropylene, polycarbonate, ABS, polycarbonate/ABS blend, high density polyethylene, carbon fibre composites, glass reinforced plastics, nylon, a long strand glass, carbon or aramid fibre material in a modulus carrier, ABS, TPU or nylon, glass fibre reinforced polypropylene, or aramid fibres in a resin carrier.

45. Protective headgear as claimed in claim 32 wherein the outer layer comprises a composite material.

46. Protective headgear as claimed in claim 32 wherein the outer layer is a laminate structure.

47. Protective headgear as claimed in claim 32 wherein the outer layer comprises any one or more thermoplastic elastomers.

48. Protective headgear as claimed in claim 32 wherein the outer layer is reinforced with high stiffness, low elongation fibres.

49. Protective headgear as claimed in claim 32 further comprising a layer of low density foam located between the shell and the head of a user.

50. Protective headgear as claimed in claim 32 further comprising a layer of incompressible fluid located between the shell and the head of a user and encapsulated in a flexible sac.

51. Protective headgear as claimed in claim 50 wherein the incompressible fluid is a fluid which resists flow between compartments in order to damp motion of the shell.

52. Protective headgear as claimed in claim 32 wherein upon failure of the outer layer, the headgear maintains levels of stress in the brain below 20 kpa.

53. Protective headgear as claimed in claim 1 wherein upon failure of the rupturing means, the headgear maintains levels of stress in the brain below 20 kpa.

54. Protective armour comprising:

a base layer having an inwardly facing surface which in use faces the body of a user of the armour and an outwardly facing surface which in use faces away from the body of a user;

an outer layer which overlies at least a portion of the outwardly facing surface of the base layer; and rupturing means for fixedly attaching the outer layer to a remainder of the armour at one or more locations, wherein:

the rupturing means is configured so as to fail when a force greater than a selected threshold is received on an outer surface of the armour which acts in an at least part tangential direction to rotate the armour and the body of the user, and upon failure of the rupturing means at the one or more locations, the received force causes at least part of the outer layer receiving the force to move relative to the base layer in a manner which is similar to the protective movement of the human scalp relative to the skull.

55. Protective armour comprising:

a base layer having an inwardly facing surface which in use faces the body of a user of the armour and an outwardly facing surface which in use faces away from the body of a user;

an outer layer which overlies at least a portion of the outwardly facing surface of the base layer; and means for fixedly attaching the outer layer to a remainder of the armour at one or more locations, wherein:

the outer layer is configured so as to fail when a force greater than a selected threshold is received on an outer surface of the armour which acts in an at least part tangential direction to the outer surface of the armour to rotate the armour and the body of the user, and upon failure of the outer layer, the received force causes at least part of the outer layer receiving the force to move relative to the base layer in a manner which is similar to the protective movement of the human scalp relative to the skull.

56. A method of modifying existing protective headgear wherein:

an outer layer is provided to overlie at least a portion of an outwardly facing surface of the existing protective headgear; and rupturing means are provided for fixedly attaching the outer layer to the existing protective headgear at one or more locations, the rupturing means being configured so as to fail when a force greater than a selected threshold is received on an outer surface of the modified headgear which acts in an at least part tangential direction to rotate the modified headgear and the head of the user, and upon failure of the rupturing means at the one or more locations, the received force causes at least part of the outer layer receiving the force to move relative to the outwardly facing surface of the existing protective headgear in a manner which is similar to the protective movement of the human scalp relative to the skull.

57. A method of modifying existing protective headgear wherein:

an outer layer is provided to overlie at least a portion of an outwardly facing surface of the existing protective headgear; and means is provided for fixedly attaching the outer layer to the existing protective headgear at one or more locations, the outer layer being configured so as to fail when a force greater than a selected threshold is received on an outer surface of the modified headgear which acts in an at least part tangential direction to the outer surface of the modified headgear to rotate the modified headgear and the head of the user, and upon failure of the outer layer, the received force causes at least part of the outer layer receiving the force to move relative to the outwardly facing surface of the existing protective headgear in a manner which is similar to the protective movement of the human scalp relative to the skull.

58. A method of modifying existing protective armour wherein:

an outer layer is provided to overlie at least a portion of an outwardly facing surface of the existing protective armour; and rupturing means are provided for fixedly attaching the outer layer to the existing protective armour at one or more locations, the rupturing means being configured so as to fail when a force greater than a selected threshold is received on an outer surface of the modified armour which acts in an at least part tangential direction to rotate the modified armour and the body of the user, and upon failure of the rupturing means at the one or more locations, the received force causes at least part of the outer layer receiving the force to move relative to the outwardly facing surface of the existing protective armour in a manner which is similar to the protective movement of the human scalp relative to the skull.

59. A method of modifying existing protective armour wherein:

an outer layer is provided to overlie at least a portion of an outwardly facing surface of the existing protective armour; and means is provided for fixedly attaching the outer layer to the existing protective armour at one or more locations, the outer layer being configured so as to fail when a force greater than a selected threshold is received on an outer surface of the modified armour which acts in an at least part tangential direction to the outer surface of the modified armour to rotate the modified armour and the body of the user, and upon failure of the outer layer, the received force causes at least part of the outer layer receiving the force to move relative to the outwardly facing surface of the existing protective armour in a manner which is similar to the protective movement of the human scalp relative to the skull.

* * * * *

UNITED STATES PATENT AND TRADEMARK OFFICE

CERTIFICATE OF CORRECTION

PATENT NO. : 8,615,817 B2
APPLICATION NO. : 10/483281
DATED : December 31, 2013
INVENTOR(S) : Kenneth David Phillips It is certified that error appears in the above-identified patent and that said Letters Patent is hereby corrected as shown below:

On the Title Page in item 73, in "Assignee," please delete "Phillips Helmets Limited, Middlesex (GB)" and insert:

-- MIPS AB, Stockholm (SE) --

Signed and Sealed this
Twenty-fifth Day of November, 2014

Michelle K. Lee

Michelle K. Lee
*Deputy Director of the United States Patent and Trademark Office*